United States Patent [19]

Zimmerman

[11] Patent Number: 4,723,667

[45] Date of Patent: Feb. 9, 1988

[54] CHASSIS OF A HEAVY ROAD VEHICLE PARTICULARLY A MULTIAXLE MOBILE CRANE

[76] Inventor: Ernst Zimmerman, Bondelistrasse 54/701, Wabern CH-3084, Switzerland

[21] Appl. No.: 5,158

[22] PCT Filed: Feb. 14, 1986

[86] PCT No.: PCT/CH86/00021

§ 371 Date: Dec. 11, 1986

§ 102(e) Date: Dec. 11, 1986

[87] PCT Pub. No.: WO86/04884

PCT Pub. Date: Aug. 28, 1986

[30] Foreign Application Priority Data

Feb. 15, 1985 [CH] Switzerland ..... 692/85

[51] Int. Cl.[4] ..... B66C 23/78

[52] U.S. Cl. ..... 212/189

[58] Field of Search ..... 212/189, 255; 280/763.1, 766.1; 254/418, 423

[56] References Cited

U.S. PATENT DOCUMENTS

| | | | |
|---|---|---|---|
| 2,400,803 | 5/1946 | Barnhart | 212/189 |
| 2,910,189 | 10/1959 | Scheuerpflug | 212/189 |
| 2,914,194 | 11/1959 | Brown | 212/189 |
| 3,393,810 | 7/1968 | Craighead | 212/189 |
| 4,387,814 | 6/1983 | Beduhn et al. | 212/189 |

FOREIGN PATENT DOCUMENTS

| | | | |
|---|---|---|---|
| 1756144 | 3/1970 | Fed. Rep. of Germany | 212/189 |
| 2229640 | 12/1974 | France | 212/189 |
| 315419 | 9/1956 | Switzerland | 212/189 |
| 1554735 | 10/1979 | United Kingdom | 212/189 |

*Primary Examiner*—Joseph F. Peters, Jr.
*Assistant Examiner*—Stephen P. Avila
*Attorney, Agent, or Firm*—Sherman and Shalloway

[57] ABSTRACT

The carriage of a mobile crane (4) is provided with middle (1), rear (2), and front (3) outrigger pairs. The middle, double casing outrigger pair (1) is disposed between the frontmost rear wheels (7) and the rearmost front wheels (8), and has the largest outrigger spread (a) which is namely at least 1.66 times as great as the spread (b) of the rear, single casing outrigger pair (2). The front outrigger pair (3) has only two vertical cylinders (11, 12), and is not telescopically extendable transversely to the longitudinal axis (X) of the carriage. The centers of at least five of the six vertical cylinders (11, 12, 13, 14, 15) belonging to the three outrigger pairs (1, 2, 3) lie on the circular arc (10) having the center (A) of the slewing rim as the center (i.e., generating center) of said arc.

5 Claims, 2 Drawing Figures

CHASSIS OF A HEAVY ROAD VEHICLE PARTICULARLY A MULTIAXLE MOBILE CRANE

The invention relates to the chassis of a heavy road vehicle, particularly the carriage of a multiaxle mobile crane, according to the preamble of claim 1.

It is known to equip the chassis of, e.g., mobile cranes, with outriggers which extend transversely to the longitudinal axis of the vehicle. The support base for the operating position is increased by extending the outriggers with their vertical cylinders set on the ground. Thereby, much heavier loads can be lifted by the crane than would be possible without the outriggers.

Ordinarily, such mobile cranes are provided with two double casing outriggers of equal length—one pair for the front and one for the rear (considered with respect to the forward direction of travel of the vehicle). The rear pair of double casing outriggers forms the rear end of the mobile crane, and is always disposed to the rear of the rearmost rear axle. The front pair of double casing outriggers is always disposed between the slewing rim and the forwardmost front axle. As a rule, the front outrigger pair is disposed at a distance from the slewing rim which is at least as great as the distance from the slewing rim to the rear outrigger pair.

The two outrigger pairs of equal length form a 4-point support system, the connecting lines of which (also called "tilting edges") define a support surface which is at least square (but most often is rectangular), which surface to some extent determines whether the crane lifts a load successfully or whether it overturns. In the case of a rectangular support surface, the longer side runs parallel to the longitudinal axis of the vehicle.

The lifting capacity is determined by the shortest distance from the center of the slewing rim to the intersection point (i.e., terminus or vertex point) of the lateral connecting lines ("tilting edges") which run parallel to the longitudinal axis of the vehicle. A circle with radius equal to this distance from the center of the slewing rim forms a locus around the slewing rim upon which locus ideally all the outrigger support points should be disposed.

However, such 4-point support systems have major disadvantages, because in the case of a square support surface there are at best 4 contact points with the circle. In the case of a rectangular support surface there are only two contact points, which indicates poor utilization of the outrigger means.

According to the present invention, 3 outrigger pairs are employed, wherewith the middle, immediately forward of the slewing ring positioned double casing outrigger pair has the largest outrigger spread and dictates the radius of the circle upon which additional support points must lie. That radius is namely the distance from the middle of the slewing rim to the center of a vertical cylinder of the middle outrigger pair.

The centers of the vertical cylinders of the rear outrigger pair at the rear of the crane lie on the said circular line. The rear outrigger pair has a single casing construction in which the outrigger beams can meet in the middle in a common housing, when they are fully retracted.

The two short outrigger beams can be spread by means of, e.g., only one telescoping cylinder. This type of rear outrigger pair has a weight and cost about one-third the weight and cost of customarily used rear double casing outrigger pairs.

The centers of the vertical cylinders of the front outrigger pair are also disposed on the aforesaid circular line.

This outrigger pair comprises only two vertical cylinders, and is not extendable transversely to the longitudinal axis of the vehicle as are the middle and rear outrigger pairs. Because the part of the carriage forward of the outriggers does not have to accommodate any of the large bending and torsion forces exerted from the load-lifting device, this front part can have a much narrower, lighter, and cheaper construction than with former structures. The narrow front part also permits the front axle to have a larger turning angle, thereby making it easier to achieve the prescribed turning circles (i.e., to execute necessary tight-radius turns).

The front and middle outrigger pairs offer the user the major advantage to transport heavy loads on truck or low-bed trailers very close along the front part of the carriage, passing the front outrigger which does not protrude, as far as to the middle outrigger, in order to transfer the heavy loads as near as possible to the slewing rim. This could not be accomplished using the above-described common 4-point outrigger system with double casing outriggers of equal spread.

A lighter and less costly carriage is enabled as a result of the major weight savings in the front part of the carriage, and the use of a single casing structure for the rear outrigger pair instead of the former double casing outrigger pair. At the same time, the load capacity of the load lifting device is approximately the same as that for mobile cranes having the above-described 4-point outrigger system.

Multiaxle mobile cranes having a structure according to the preamble of claim 1 have a trapezoidal support surface (support configuration) from the middle outriggers to the rear outriggers, and the same geometry from the middle to the front outriggers. Thus overall there is a double trapezoidal support configuration.

The invention will be described in more detail hereinbelow, with reference to the drawings, which illustrate an exemplary embodiment.

Figure 1:
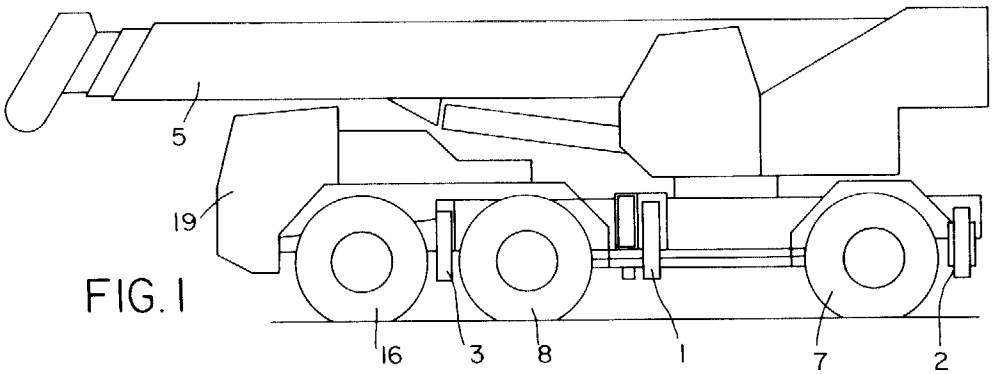
FIG. 1 is a schematic view of a mobile crane.

Heavy road vehicles, particularly mobile cranes with multiaxle carriages (4), have at least one front outrigger pair (3), one middle outrigger pair (1), and one rear outrigger pair (2), all of which outrigger pairs are different. The middle pair (1) is in the form of a double casing outrigger pair for the largest outrigger spread (a), and is disposed between the frontmost rear axle (7) and the rearmost front axle (8) (considered with respect to the forward direction of travel of the vehicle) and immediately forward of the slewing rim (6) which supports the load lifting apparatus. The shortest distance (c) from the middle wall (9) of the double casing outrigger pair (1) (which wall runs transversely to the longitudinal axis (X) of the vehicle) to the center point (A) of the slewing rim (6) is at least equal to the radius of the antifriction bearing (6a) of the slewing rim and is at most equal to twice said radius.

The outrigger spread (a) of the middle outrigger pair (1) is at least 1.66 times the spread (b) of the rear outrigger pair (2).

The rear, single casing outrigger pair (2) is disposed at the rear of the carriage (4). The two outrigger beams (17) of outrigger pair (2) can come into contact when they are fully retracted in their common housing; namely, they can contact in the center, at the location of the longitudinal axis (X). The middle (1) and rear (2) outrigger pairs are both of telescoping construction. (The telescoping mechanisms are not illustrated.)

Figure 2:
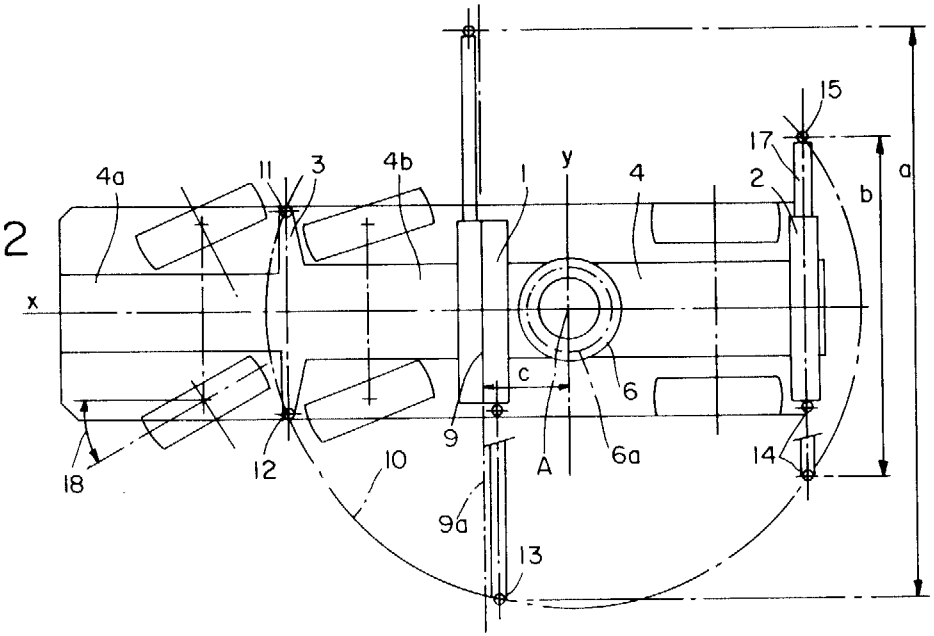
FIG. 2 is a plan view of the inventive carriage of the mobile crane according to FIG. 1, with the load lifting apparatus of the crane omitted.

The front outrigger pair (3) is disposed at least forward of the rearmost front axle (8). It has only one pair of verticle cylinders (11, 12), which cylinders are disposed within the width of the carriage. The distance of each of the two vertical cylinders (11, 12) from the center (A) of the slewing rim (6) is equal to the radius of the circular line (10) which passes through the center of at least one of the vertical cylinders (13) of the middle outrigger pair (1), when said outriggers are extended, and through the centers of both of the vertical cylinders (14, 15) of the rear outrigger pair (2) as shown in FIG. 2. The center of one of the two verticle cylinders of the middle outrigger pair (1) is disposed immediately within or immediately outside of the circular line (10); however, for purposes of calculating the lifting capacity of the load lifting apparatus, said center is considered to also lie on the circular line (10). These 6 support points on the circular line around the center (A) of the slewing rim afford a substantially greater range of usefulness than the former known 4-point support system, of which circular line through the support points usually did not pass through the center of the slewing rim, and when it did have such it had it only by accident (not by intention).

The high bending and torsion forces which arise when loads are moved by the load lifting apparatus (5) are transmitted via the slewing rim 6 to the carriage (4) rim disposed middle outrigger (1), which takes over the major forces if the crane is operating transversely to the longitudinal axis (X).

The rear outrigger pair (2), the vertical cylinders (14, 15) of which are also disposed on the circular line (10), bears bending and torsion forces of at least the same magnitude as those borne by the middle outrigger pair (1). With this arrangement, the usual double casing outrigger pair, which is at least three times as heavy and costly as a single casing outrigger pair is avoided.

The front outrigger pair (3), the vertical cylinders (11, 12) of which are also disposed on the circular line (10), transmits bending and torsion forces of at least the same magnitude as those borne by the middle outrigger pair (1), but is disposed forward of the rearmost front axle (8). This allows the front part (4*a*) of the carriage which part is disposed forward of the front outriggers (3) to be narrower by at least half the width of the outrigger beam (17) of the rear outrigger pair (2), and thereby lighter and less costly, than the segment (4*b*) of the carriage between the front (3) and rear (2) outrigger pairs.

The narrower carriage segment (4*a*) allows the wheels of the other front axles (16) to have a greater turning angle, which makes it easier to achieve the prescribed turning radius of the mobile crane, and greatly increases the mobile crane's maneuverability.

The front outrigger pair (3) is not telescopable transversely to the longitudinal axis (X) as are the middle (1) and rear (2) outrigger pairs, because the type of structure needed for this (e.g., a double casing outrigger pair) cannot be accommodated, due to the presence (typically) of an engine, transmission, and drive train.

It is seen from FIG. 2 that the outer connecting lines between the centers of the 6 vertical cylinders which lines are also called "tilting edges" form a pair of trapezoids. There is a small trapezoid formed from the middle (1) to the front (3) outrigger pair, and a large trapezoid formed from the middle (1) to the rear (2) outrigger pair. The support system is referred to as a "double trapezoid" support system.

The forward direction of travel is indicated by the vehicle cab (19) on the carriage (4).

I claim:

1. A chassis of a heavy road vehicle, particularly the carriage of a multiaxle single vehicle mobile crane, comprised of a slewing rim (6) which supports a load lifting apparatus (5), further comprised of a middle outrigger pair (1) as well as a rear (2) and a front (3) outrigger pair with respect to a forward direction of travel of said vehicle, the middle outrigger pair (1) having a double casing structure and having the largest outrigger spread (a), and is disposed between the frontmost rear wheels (7) and the rearmost front wheels (8), and wherein the front outrigger pair (3), which is not telescopable transversely to a longitudinal axis (x) of the vehicle, is disposed so far forward as to be at least forward of the rearmost front wheels (8); characterized in that the middle outrigger pair (1) is disposed immediately forward of the slewing rim (6), and has a greatest outrigger spread (a) which is at least 1.66 times as great as the greatest spread (b) of the rear outrigger pair (2), further wherein a fixed circular arc (10) centered at the center point (A) of the slewing rim always passes through the centers of two vertical cylinders (11,12) of the front outrigger pair (3), through the center of at least one (13) vertical cylinder of the telescoping middle outrigger pair (1), at maximum extension thereof and through the centers of two vertical cylinders (14,15) of the telescoping rear outrigger pair (2) at maximum extension thereof.

2. A chassis according to claim 1, characterized in that, considered in the plan view, the distance (c) from a middle wall (9) of the double casing outrigger pair (1), which wall runs transversely to the longitudinal axis (X) of the vehicle to the center point (A) of the slewing rim (6) is at least equal to the radius of an antifriction bearing (6*a*) of the slewing rim and is at most equal to twice said radius.

3. A chassis according to claim 1, characterized in that the circular arc (10) centered at the center point of the slewing rim passes through the centers of two vertical cylinders (11,12) of the front outrigger pair (3), through the center of at least one (13) vertical cylinder of the telescoping middle outrigger pair (1), and through the centers of two vertical cylinders (14, 15) of the telescoping rear outrigger pair (2).

4. A chassis according to claim 1, characterized in that a segment (4*a*) of said chassis which segment bears front wheels (16) is narrower than a segment (4*b*) of said chassis between the front (3) and rear (2) outrigger pairs, said first mentioned segment being narrower by an amount of at least half the width of an outrigger beam (17) of the rear outrigger pair (2).

5. A chassis according to claim 1, characterized in that vertical cylinders of the telescoping middle, outrigger pair (1), which vertical cylinders are disposed on an imaginary line (9) which is used for calculating the lifting capacity, form the base of a double trapezoid, wherein a smaller trapezoid is bounded by vertical cylinders (11,12) of the front outrigger pair (3), and a second trapezoid is bounded by vertical cylinders (14, 15) of the rear, telescoping outrigger pair (2).

* * * * *

UNITED STATES PATENT AND TRADEMARK OFFICE

CERTIFICATE OF CORRECTION

PATENT NO. : 4,723,667

DATED : February 9, 1988

INVENTOR(S) : Ernst ZIMMERMAN

It is certified that error appears in the above-identified patent and that said Letters Patent is hereby corrected as shown below:

On the Title Page, "5 Claims" should read -- 4 Claims --.

Column 4, lines 44-51, (Claim 3) should be deleted.

Signed and Sealed this

Twenty-eighth Day of June, 1988

*Attest:*

DONALD J. QUIGG

*Attesting Officer*

*Commissioner of Patents and Trademarks*